United States Patent [19]

Schliof

[11] Patent Number: 4,792,498

[45] Date of Patent: Dec. 20, 1988

[54] PICTURE-REPRODUCING DEVICE

[75] Inventor: Michael Schliof, Schorndorf, Fed. Rep. of Germany

[73] Assignee: Standard Elektrik Lorenz A.G., Stuttgart, Fed. Rep. of Germany

[21] Appl. No.: 58,192

[22] Filed: Jun. 4, 1987

[30] Foreign Application Priority Data

Jun. 14, 1986 [DE] Fed. Rep. of Germany ..... 3620052

[51] Int. Cl.[4] ..... H01J 29/22

[52] U.S. Cl. ..... 428/595; 428/603; 428/630; 428/646; 428/647; 428/648; 220/2.1 A; 313/461; 313/477 R

[58] Field of Search ..... 313/461, 477 R; 220/2.1 A; 428/595, 603, 630, 646, 647, 648

[56] References Cited

U.S. PATENT DOCUMENTS 4,337,304 6/1982 Brenner, Jr. et al. ..... 313/461

FOREIGN PATENT DOCUMENTS 187026 7/1986 European Pat. Off. ..... 313/461

*Primary Examiner*—L. Dewayne Rutledge
*Assistant Examiner*—George Wyszemierski
*Attorney, Agent, or Firm*—Peter C. Van Der Sluys

[57] ABSTRACT

In a vacuum-tight picture-reproducing device having a flat glass faceplate and a metal tray-shaped back case with an outwardly curved bottom and a continuous flange, the flange has a perpendicular extension. The faceplate has end surfaces embraced by the extension and lies on the flange. The end surfaces of the faceplate and the flange with the extension are permanently joined together by a silver-containing tin-base solder. The joint may be covered by a metal layer.

10 Claims, 1 Drawing Sheet

PICTURE-REPRODUCING DEVICE

BACKGROUND OF THE INVENTION

1. Field of the Invention

The present invention relates to a picture-reproducing device having a flat glass faceplate.

2. Description of the Prior Art

A picture-reproducing device of the above kind is disclosed in DE-A-29 20 930, in which the faceplate is joined to the cone portion of the envelope by a vacuum-tight pressure-bonded seal. Between the flange of the cone portion and the rim portion of the faceplate, there is a wire of high-purity lead. The faceplate is clamped to the flange by means of a U-shaped member. The U-shaped member is tightly encompassed by a metal rim-band, so that the legs of the U-shaped member exert a wedging action and urge the faceplate towards the flange. The vacuum-tight pressure-bonded seal is produced in a heatable press. The metal rim-band is shrunk onto the picture-reproducing device when the latter has been removed from the press and cooled to room temperature.

SUMMARY OF THE INVENTION

It is an object of the present invention to provide a picture-reproducing device of the kind mentioned above so that a differrent kind of vacuum-tight joint can be used.

The use of a vacuum-tight joint in a picture-reproducing device having a flat glass faceplate is facilitated by providing the flange of the cone portion with an extension which is perpendicular to the surface of the flange and parallel to the narrow sides of the faceplate. The flange extends to the front surface of the faceplate. The flange and the extension are permanently joined to the faceplate.

DESCRIPTION OF THE PREFERRED EMBODIMENTS

Figure 1:
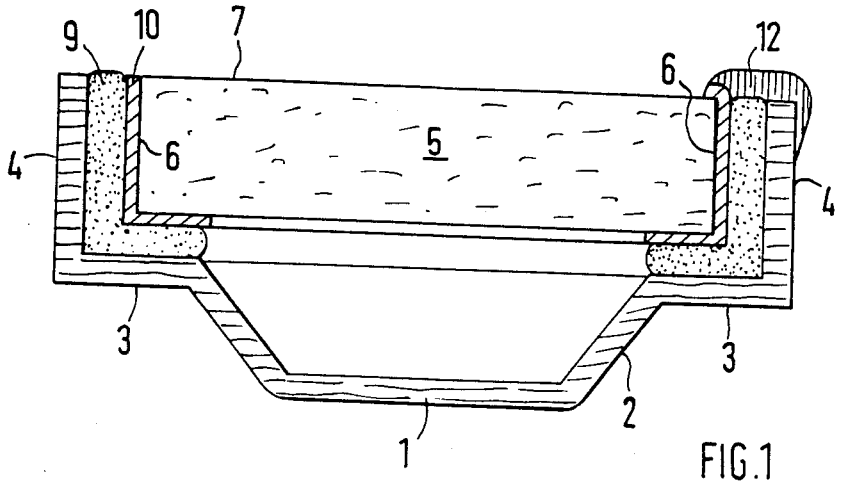
FIG. 1 is a section through a schematic representation of a picture-reproducing device.

The picture-reproducing device of FIG. 1 has a flat, metal tray-shaped back case 1 whose sidewalls 2 end in a continuous flange 3. For the sake of clarity, the electrodes present in the tray-shaped back case 1 are not shown. The tray-shaped back case 1 may, for example, be made of a nickel-iron alloy which preferably has a coefficicent of expansion which is adapted to that of the glass faceplate 5. The flange 3 ends in an extension 4 which is perpendicular to the surface of the flange 3.

The flat glass faceplate 5 forms the front side of the picture-reproducing device. Its rim portion lies on the flange 3 of the tray-shaped back case 1. The extension 4 of the flange 3 runs parallel in relation to the narrow sides 6 of the faceplate 5 and extends to the front surface 7 of the faceplate 5. The flange 3 and the extension 4 on the one hand, and the rim portion of the faceplate 5 on the other hand, are permanently joined together in a vacuum-tight manner, so as to create a totally enclosed space. Before the picture-reproducing device is put in operation, this space is evacuated. For the sake of clarity, the luminescent layer on the inside of the faceplate is not shown. The faceplate 5 is perferably made of a glass having the same coefficient of thermal expansion as the metal of the tray-shaped back case 1.

The faceplate 5 and the flange 3 with the extension 4 are permanently joined together by a tin-base solder 9 containing about 4 percent silver. To ensure that the parts described above are joined together in a vacuum-tight, stable manner, the flange 3 and the extension 4 are coated with an easily solderable metal in the area of the permanent joint; for example, they can be copper or nickel-coated, e.g., by suitable plating techniques. In the area of the permanent joint, the flat glass faceplate 5 is coated with baking silver. The baking silver can be screen-printed, sprayed or roller-coated onto the narrow sides 6 and the rear area of the faceplate 5. The baking silver used may be "Conductive Composition 590 G" manufactured by Electro Science Lab.

The faceplate 5 and the flange 3 can be joined to the extension 4 in two ways. The first method is to apply the tin-base solder 9 to the areas to be joined together and to subsequently heat the entire picture-reproducing device until the melting point of the tin-base solder is reached. The second method is to apply the tin-base solder 9 to the area intended, the picture-reproducing device having previously been heated.

Figure 2:
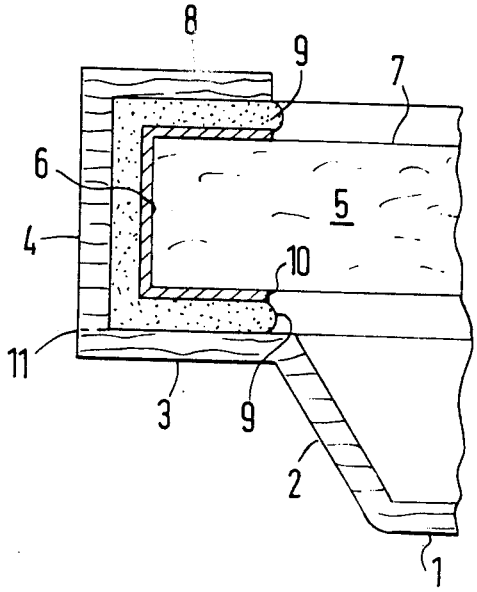
FIG. 2 is a section through another emodiment of the picture-reproducing device.

In the additional embodiment of the picture-reproducing device shown in FIG. 2, like reference numerals as in FIG. 1 are used for like parts. In this embodiment, the extension 4 has an inwardly directed rim portion 8. The permanent joint is formed here between the faceplate 5 on the one hand and the flange 3, the extension 4 and the inwardly directed rim portion 8 on the other hand.

To simplify the assembly of the picture-reproducing device, there may be a parting line 11 between the flange 3 and the extension 4. When the faceplate 5 has been placed on the flange 3, the frame consisting of the extension 4 with the inwardly directed rim portion 8 is positioned on top and soldered to the flange at the parting line 11. The parts are then permanently joined together as described above. The frame consisting of the extension 4 and the inwardly directed rim portion 8 can additionally be separated along its diagonal so as to give two rectangular frame portions.

The advantage of this embodiment of the picture-reproducing device is that an implosion protection is provided since the faceplate 5 is embraced by the flange 3, the extension 4 and the rim portion 8.

In order to avoid even the smallest leaks between the faceplate 5 and the tray-shaped baok case 1, particularly in large-size picture-reproducing devices, the joint between the faceplate 5 and the tray-shaped back case 1, particularly in large-size picture-reproducing devices, the joint between the extension 4 and the faceplate 5 can be coated with a uniform metal layer 12 as shown on the right-hand side of FIG. 1. For example, the Layer 12 may be a nickel layer applied by suitable plating techniques. To ensure that the nickel layer adheres firmly to the front surface 7 of the faceplate 5, the front surface is coated with baking silver in the area where the nickel layer is to be applied. The joint of the embodiment of FIG. 2 may also be sealed additionally in this manner.

What is claimed is:

1. A picture-reproducing device, comprising:

a flat glass faceplate with a luminescent layer applied to its inside;

a metallic tray-shaped back case with an outwardly protruding bottom;

a continuous flange formed about said back case parallel to and adjacent the inside of said faceplate;

an extension formed about said flange, perpendicular to the surface of the flange and parallel to edges of the faceplate and extending to an outside surface of the faceplate; and a joint for permanently joining the flange and the extension to the faceplate.

2. A picture-reproducing device as claimed in claim 1, additionally comprising:

an inwardly directed rim portion formed about said extension, the flange, the extension and the rim portion being permanently joined to the faceplate by said joint.

3. A picture-reproducing device as claimed in claim 1, wherein the joint between the faceplate and the flange and the extension comprises:

a silver-containing tin-base solder;

an easily solderable metal coated on the flange and the extension in the area of the joint; and a conductive composition coated on the faceplate in the area of the joint.

4. A picture-reproducing device as claimed in claim 2, wherein the joint between the faceplate and the flange, the extension and the the rim portion, comprises:

a silver-containing tin-base solder;

an easily solderable metal coated on the flange and the extension in the area of the joint; and a conductive composition coated on the faceplate in the area of the joint.

5. A picture-reproducing device as claimed in claim 3, wherein the easily solderable metal is copper or nickel.

6. A picture-reproducing device as claimed in claim 4, wherein the easily solderable metal is copper or nickel.

7. A picture-reproducing device as claimed in claim 3, wherein the tin-base solder contains about four percent silver.

8. A picture-reproducing device as claimed in claim 4, wherein the tin-base solder contains about four percent silver.

9. A picture-reproducing device as claimed in claim 1 wherein the joint between the faceplate and the extension is covered by a metal layer.

10. A picture-reproducing device as claimed in claim 2, wherein the joint between the faceplate and the rim portion is covered by a metal layer.

* * * * *

UNITED STATES PATENT AND TRADEMARK OFFICE

CERTIFICATE OF CORRECTION

PATENT NO. : 4,792,498

DATED : December 20, 1988

INVENTOR(S) : Michael Schlipf

It is certified that error appears in the above–identified patent and that said Letters Patent is hereby corrected as shown below:

On the title page, in the heading, please delete "Schliof" and insert --Schlipf--.

On the title page, at Item 75, please delete "Schliof" and insert --Schlipf--.

Signed and Sealed this

Second Day of May, 1989

*Attest:*

DONALD J. QUIGG

*Attesting Officer*

*Commissioner of Patents and Trademarks*